US005386987A

United States Patent [19]

Rodino, Jr.

[11] Patent Number: 5,386,987

[45] Date of Patent: Feb. 7, 1995

[54] TWO-IN-ONE BATTING TEE

[76] Inventor: John P. Rodino, Jr., 17730 Fairview Dr., Fontana, Calif. 92336

[21] Appl. No.: 226,827

[22] Filed: Apr. 13, 1994

[51] Int. Cl.[6] ..... A63B 69/40

[52] U.S. Cl. ..... 273/26 R

[58] Field of Search ..... 273/26 E, 29 A, 184 B, 273/200 R, 196, 197 R, 197 A, 198, 195 A

[56] References Cited

U.S. PATENT DOCUMENTS

| | | | |
|---|---|---|---|
| 2,652,250 | 9/1953 | Adler et al. . | |
| 3,039,770 | 6/1962 | Fenetti | 273/26 A |
| 3,489,411 | 1/1970 | Morelli et al. | 273/26 A |
| 3,883,138 | 5/1975 | Chorey . | |
| 4,092,023 | 5/1978 | Hazen | 273/26 A |
| 4,383,686 | 5/1983 | Cardieri . | |
| 4,664,375 | 5/1987 | Tetrault . | |
| 4,681,318 | 7/1987 | Lay . | |
| 4,709,924 | 12/1987 | Wilson et al. . | |
| 4,796,885 | 1/1989 | Wright . | |
| 4,938,478 | 7/1990 | Lay | 273/26 A |
| 4,989,866 | 2/1991 | Dill . | |
| 5,004,234 | 4/1991 | Hollis . | |
| 5,100,134 | 3/1992 | Becker . | |
| 5,184,816 | 2/1993 | Lunsford . | |
| 5,246,226 | 9/1993 | McGuinn . | |

FOREIGN PATENT DOCUMENTS

| | | |
|---|---|---|
| 2039751 | 8/1980 | United Kingdom . |
| 2070444 | 9/1981 | United Kingdom . |

*Primary Examiner*—Theatrice Brown

*Attorney, Agent, or Firm*—Richard C. Litman

[57] ABSTRACT

A new baseball practice tee and a method of assembling it, in which two different configurations can be employed to allow for various types of practice. The practice tee has a lower assembly that is common to both configurations. In this assembly, a metal tube having a rubber sleeve is mounted on a base. The standard includes a rubber cover having a cavity housing a weighted metal base that has a protrusion for attaching the tube, sleeve, and the rubber cover and metal standard. A locking pin extending through aligned holes in the protrusion and the metal tube attaches the tube to the metal standard, and holds the rubber cover in place. An upper post or a sleeve is inserted into the lower assembly to configure the novel tee as either a tethered or an upright tee, selectively. The upper post and the sleeve are interchangeable and both are adjustable. Configuration as an upright practice tee is made by inserting an adjustable sleeve, which may be made of a rubber material, into the lower post. The adjustable sleeve is held at a desired height by a friction fit, and is adjusted by moving it within the tube. The tethered configuration is made by inserting an upper post, which can be made of plastic, into the lower post. An arm extends perpendicularly from the upper part of the upper post, and tethers a ball by a cord. The upper post has several adjusting holes through which an adjusting pin secures it to the lower post and sleeve arrangement on the lower tee assembly.

15 Claims, 5 Drawing Sheets

TWO-IN-ONE BATTING TEE

BACKGROUND OF THE INVENTION

1. Field of the Invention

The present invention relates to a batting practice tee that can be converted from an upright tee to a tethered tee. A method of assembling a convertible batting practice tee is also set forth below.

2. Description of the Prior Art

The convertible batting practice tee is useful for training young ball players. The use of an upright batting tee is an important first step in learning to hit a ball. A tethered batting tee is useful in helping the young ball player develop hand-eye coordination and timing. Because both types of tees have a specialized use, it is desirable to have both, either to teach one ball player multiple skills or to teach several ballplayers or children at different levels.

Heretofore, it has been necessary to purchase two complete practice tees to have the benefit of both types.

Following are previously patented inventions which disclose practice tees having the above-noted limitation in that they provide the practice of only one type of batting tee:

U.S. Pat. No. 2,652,250, issued Sep. 15, 1953 to Orin J. Adler et al., discloses an adjustable boom which mounts a standard on which a baseball can rest. Batting practice can be varied by changing the position of the boom.

U.S. Pat. No. 3,883,138, issued May 13, 1975 to Andro J. Chorey, discloses tubes extending upwardly from a metal base to form a support for an annular flange which supports a ball in an upright batting tee arrangement. The tubes are telescopically engaged for adjusting height and locked at a specific height relative to each other by a wing screw inserted through a hole in the outer tube and tightened against the inner tube.

U.S. Pat. No. 4,383,686, issued May 17, 1983 to Edward Cardieri, discloses an upright batting tee with tubes extending upwardly from a base to form a support for a flexible ball support member. The base comprises upper and lower base members. The tubes are telescopically engaged for adjusting height and locked at a specific height relative to each other by a set bolt inserted through a threaded aperture in the outer tube and tightened against the inner tube. The batting tee is foldable for storage.

U.S. Pat. No. 4,664,375, issued May 12, 1987 to Albert G. Tetrault, discloses a batting practice device in which a baseball is tethered over a plate. The tether arrangement is supported by a horizontal arm attached at the upper end of a vertical arm. The vertical arm is attached to the plate by a horizontal ground arm.

U.S. Pat. No. 4,681,318, issued Jul. 21, 1987 to William C. Lay, discloses an upright batting tee with tubes extending upwardly from a rubber base to form a support for a flexible ball support member. The base comprises upper and lower base members. The tubes are telescopically engaged for adjusting height and locked at a specific height relative to each other by a lock bolt inserted through a threaded hole in the outer tube and tightened against the inner tube. A locking pin is provided at the lower portion of the lower tube to lock a ball joint in place to secure the tee in a pivoted position.

U.S. Pat. No. 4,709,924, issued Dec. 1, 1987 to Richard A. Wilson et al., and U.S. Pat. No. 4,796,885, issued Jan. 10, 1989 to Robert L. Wright, each disclose a plate member shaped like home plate spaced apart from a second plate member. Telescoping posts extending upwardly from the second base may be frictionally engaged to lock them at a certain height relative to each other. The upper and lower posts may be made of a resilient material, and the lower post may include a metal liner for additional strength.

U.S. Pat. No. 4,989,866, issued Feb. 5, 1991 to David N. Dill, and U.S. Pat. No. 5,004,234, issued Apr. 2, 1991 to Ray A. Hollis, each disclose an adjustable upright batting tee including a baseball home plate mounting an adjustable vertical tube.

U.S. Pat. No. 5,100,134, issued Mar. 31, 1992 to Roland Becker, discloses an upright batting tee where two tubular members telescopically engage each other and are frictionally engaged at a desired height. The upper end of the upper tube supports a flexible ball holder. The apparatus can be disassembled without difficulty.

U.S. Pat. No. 5,184,816, issued Feb. 9, 1993 to T. J. Lunsford, discloses a hitting practice device in which a ball is tethered from an arm. The height of the device can be varied by adjusting screws.

U.S. Pat. No. 5,246,226, issued Sep. 21, 1993 to Danny L. McGuinn, discloses a batting practice apparatus in which a ball is tethered from an arm. The height of the device can be varied by adjusting two telescopically engaged posts and locking them to a desired height with a threaded handle.

British patent No. 2,039,751, published Aug. 20, 1980, discloses a shaft that is driven into the ground that tethers a British patent No. 2,070,444, published Sep. 9, 1981, discloses a ball game training aid in which a ball is tethered from a boom supported by a tripod.

None of the above inventions and patents, taken either singly or in combination, is seen to describe the instant invention as claimed.

SUMMARY OF THE INVENTION

The convertibility of the batting tee provided by this invention reduces the cost of owning both types of tee. Because the convertible batting practice tee has a lower assembly that is common to both the upright and tethered tee, the purchase of the convertible batting practice tee merely involves purchasing the lower assembly and two upper assemblies for upright and tethered training (an adjustable sleeve and an upper post).

The present invention provides a batting tee that also has the benefits of easy storage and portability. Heretofore, a user and an owner of both types of batting tees was faced with storing and transporting two cumbersome batting tees with the weight and size of two lower assemblies. However, this invention allows for one to store or transport both batting tees without this added weight or size because only one lower assembly is required. A further benefit is that the batting practice tee can be easily disassembled for storage or transportation.

This practice batting tee further provides the advantage of simplicity in its use. The conversion from one batting tee to another is accomplished by simply removing a sleeve and replacing it with a post. The batting tee is easily adjustable in either configuration. Heretofore, to use batting tees in each configuration and gain the benefit of both types of practice, one was forced to use a completely different batting tee with its own lower assembly.

A further advantage of this invention is the coexistence of rigidity and stability with safety. The weighted metal construction of the lower assembly of the batting tee provides rigidity and stability. However, the advantages provided by this metal construction are not at the expense of safety. The metal parts are covered by parts made of a rubber material and are safe for children. Further, the rubber material provides for shock absorption in the event the tee is hit.

Accordingly, it is a principal object of the invention to provide a batting tee that is easily convertible from an upright tee to a tethered tee. This object is accomplished by providing a lower assembly into which either an adjustable rubber sleeve dimensioned and configured to receive a ball thereupon or an upper post tethering a ball can be inserted.

It is another object of the invention to provide a tee that is easily adjustable so that it can accommodate users of different heights. This object is accomplished by tolerancing the adjustable sleeve so that it frictionally engages the lower assembly. The height of the upper post tethering assembly is adjustable through the use of an adjusting pin and mating holes.

It is a further object of the invention to provide a batting tee that can easily be disassembled for storage and portability. For this reason, the base has a protrusion on which the metal post is locked with a removable locking bolt. Additionally, easily removable locking pins are used to connect the upper post to the upper end of the lower post, the upper post to the arm, and the arm to the tether sleeve.

Still another object of the invention is to provide a batting tee that is both strong and safe for children. A metal lower post and a metal standard are used to impart strength and rigidity to the batting tee. To make the batting tee safe for children the metal lower post and the metal standard are covered by a sleeve and a cover each made from a rubber material. This rubber material results not only in a safer batting tee, but also in one that absorbs shocks if it is accidentally hit.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
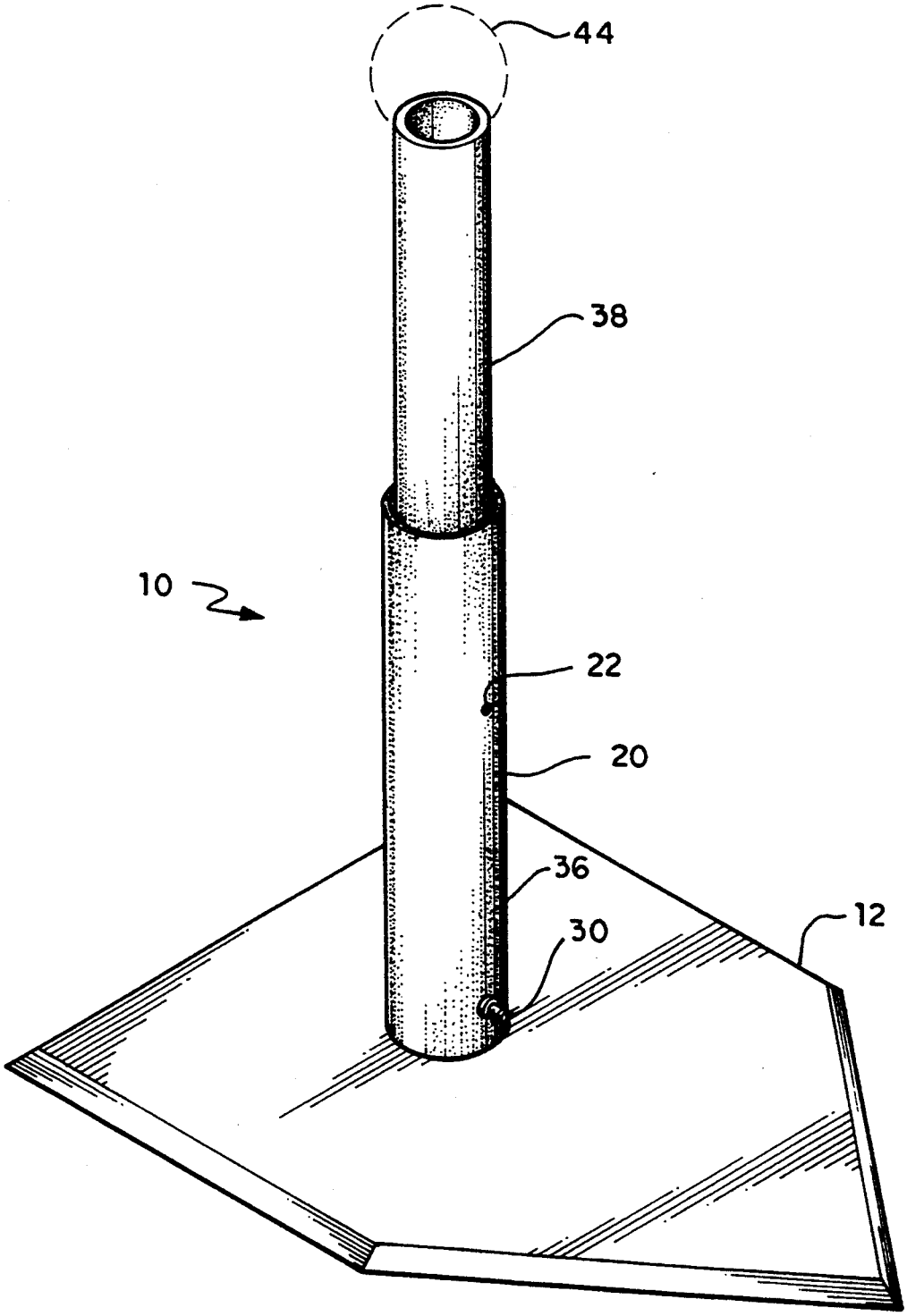
FIG. 1 is a perspective view of the invention shown configured as an upright tee.
Figure 2:
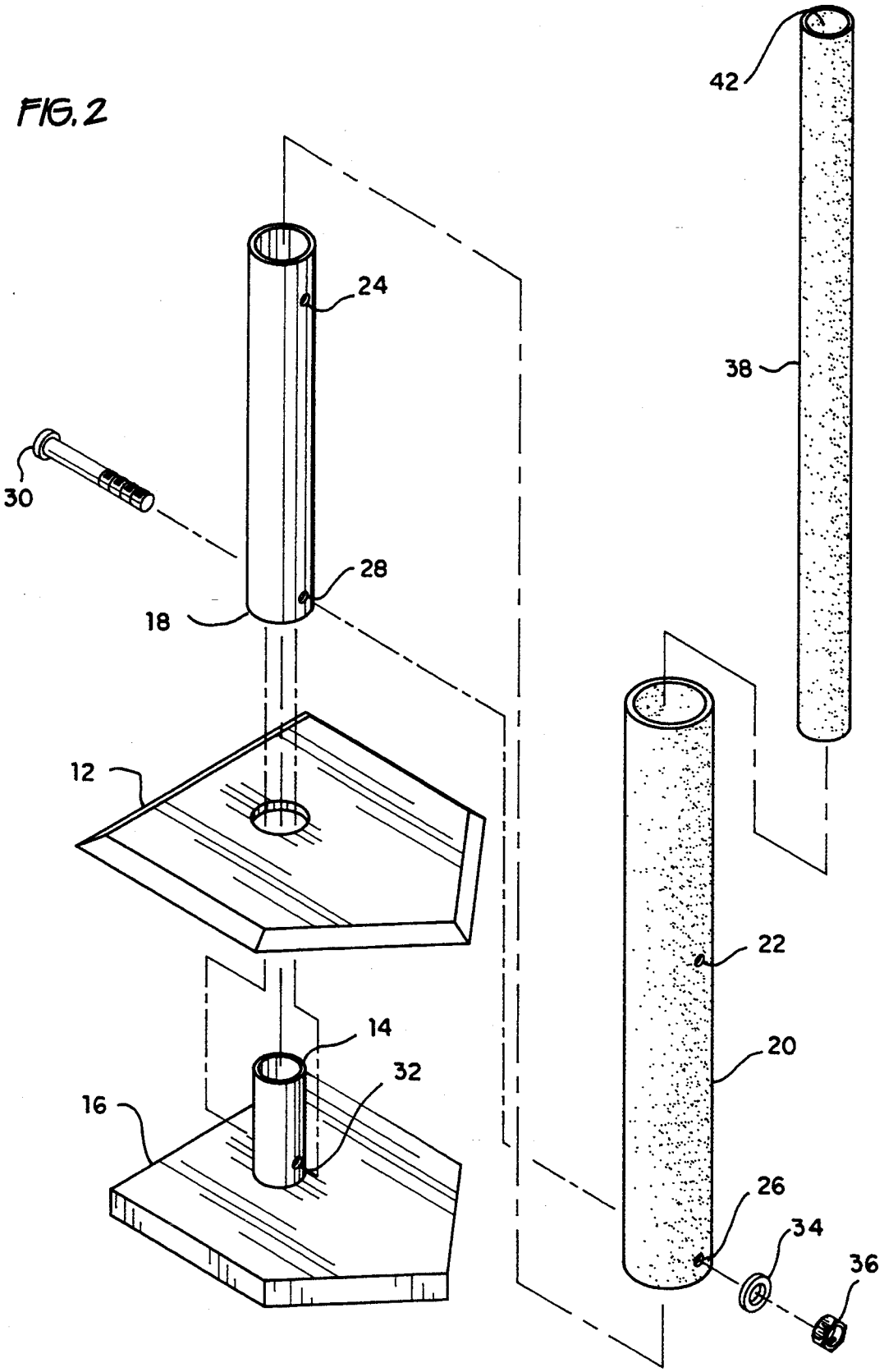
FIG. 2 is an exploded perspective view of the batting tee of FIG. 1.
Figure 3:
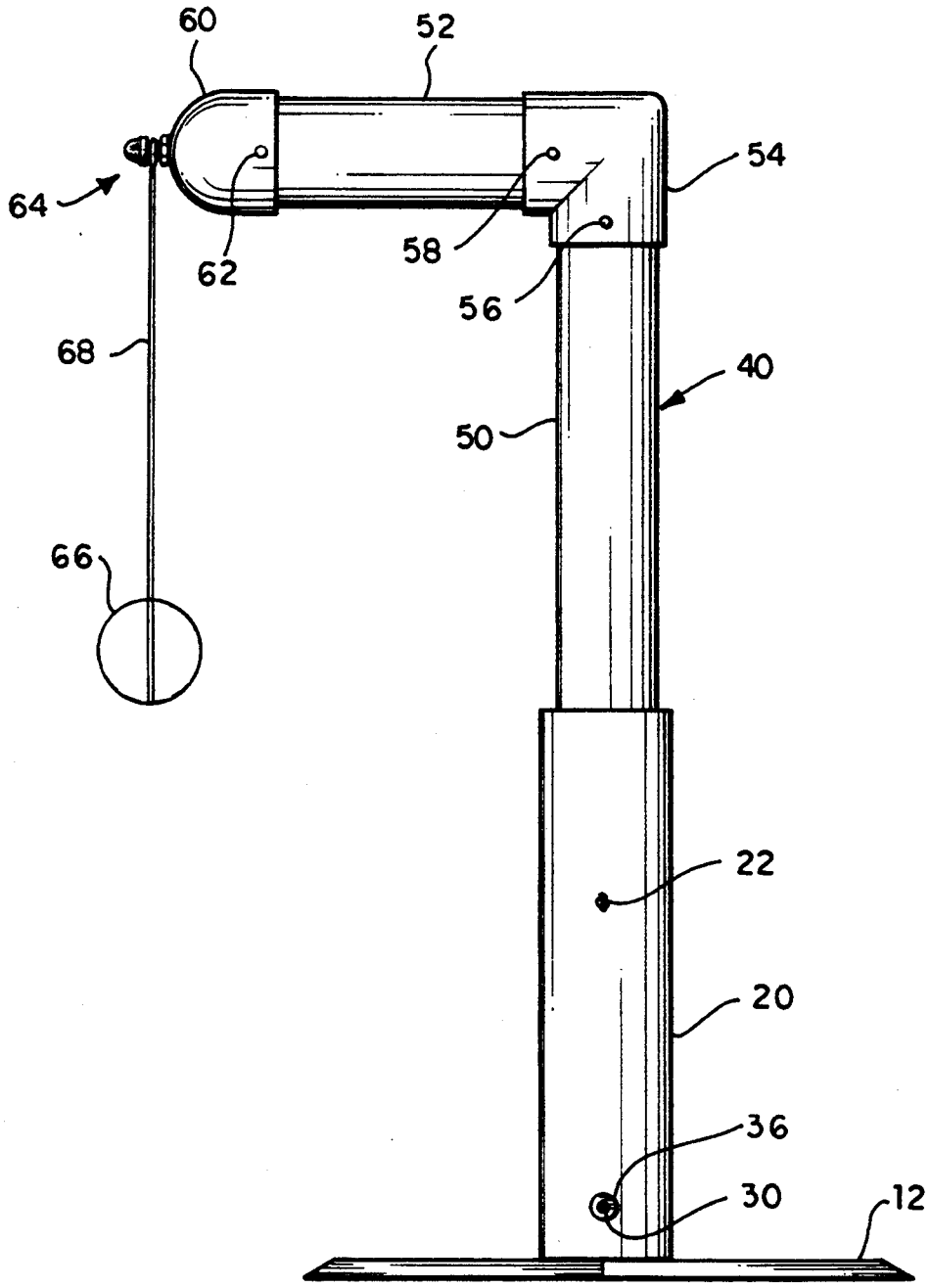
FIG. 3 is a side elevational view of the invention, configured as a tethered tee.

The present invention relates to a batting tee that is easily assembled and easily convertible to allow the types of practice allowed by upright and tethered batting positions. Configuration as an upright tee 10 is shown in FIG. 1. The components of the tee, shown in FIG. 2, are assembled by placing a cover 12, preferably made of a rubber material, over a tubular protrusion 14 extending upwardly from a substantially standard 16, preferably fabricated from metal and of a weight sufficient to provide stability to the tee. A Lower post 18, preferably a metal tube, is placed over the protrusion 14. A resilient sleeve 20 is placed over the lower post 18. The mating hole 22 at the upper end of the sleeve 20 is lined up with the lower post mating hole 24, and a locking hole 26 at the lower end of the sleeve 20 is lined up with a lower post locking hole 28. The assembly of the lower post 18 and resilient sleeve 20 to the tubular protrusion 14 is secured by a placing a locking bolt 30 through the locking holes 28 and 26 and the protrusion locking hole 32 and fastening the bolt 30 by placing a washer 34 over it and screwing a nut 36 onto it.

This lower assembly is common to both the upright and the tethered tee arrangements, and it is a simple matter to change configurations by employing, selectively, an adjustable sleeve 38, preferably made out of a rubber material, or a tether assembly 40, preferably made of plastic. The adjustable rubber sleeve 38 is inserted into the lower post 18 as shown in FIG. 2 to achieve the upright configuration. The adjustable rubber sleeve 38 can be adjusted by sliding it up and down within the lower post 18 and is held in place by a friction fit. The upper terminal end 42 of the adjustable rubber sleeve 38 is dimensioned and configured to mount a baseball 44, as shown in phantom lines in FIG. 1. Alternatively, a whiffle ball may be mounted on the upper terminal end 42 of the adjustable rubber sleeve 38.

Figure 4:
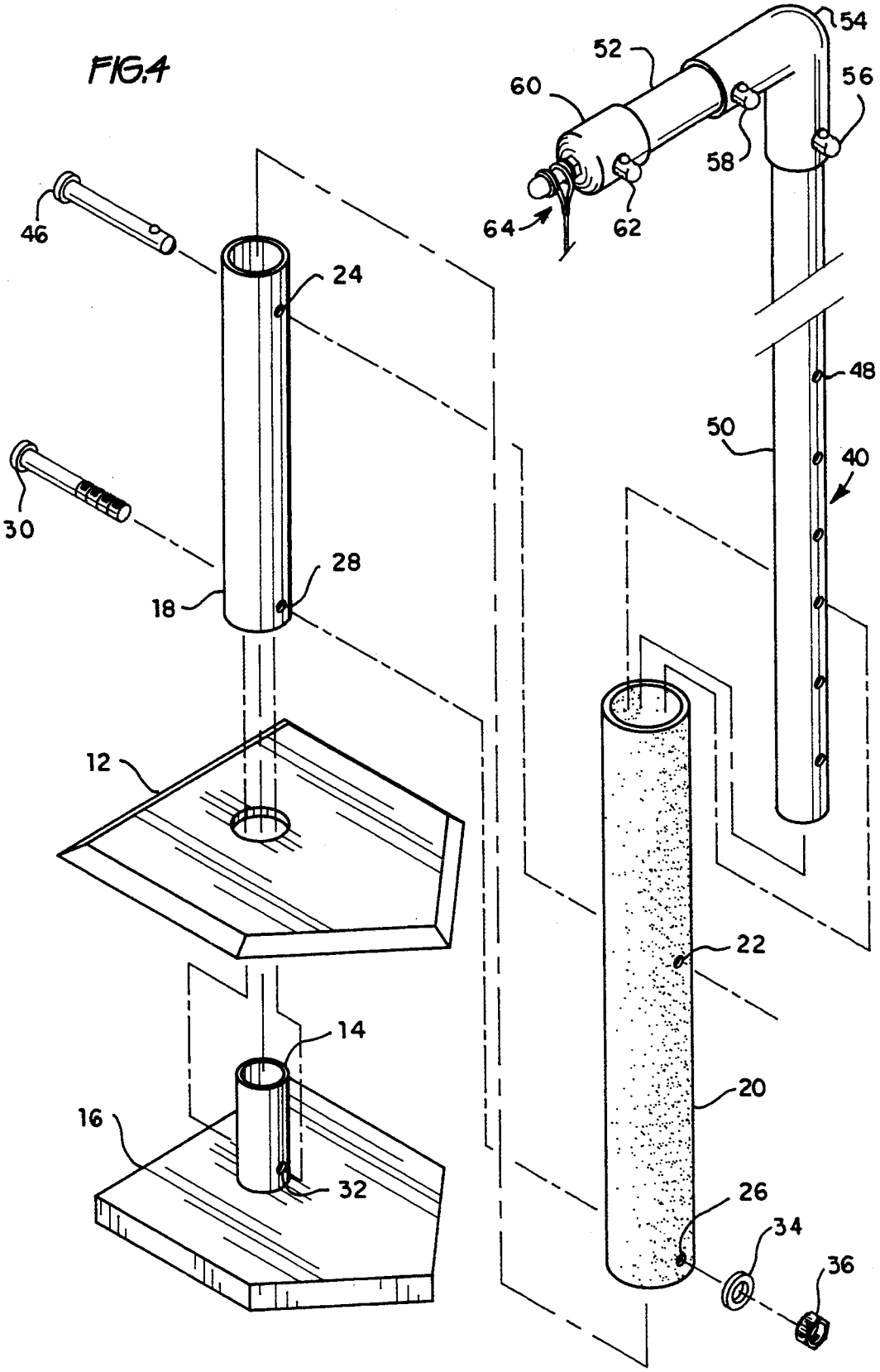
FIG. 4 is an exploded perspective view of the batting tee of FIG. 3.

The tethered configuration is achieved as follows. The tether assembly 40 is inserted into the lower post 18, as shown in Figure 4. It can be adjusted by sliding it up and down within the lower post 18 and is held in place by a locking pin 46 inserted through one of several mating holes 48 in the tether assembly and mating holes 24 and 22 in the lower post 18 and its associated resilient sleeve 20.

The tether assembly has an upper post 50 and an arm 52 connected by an elbow 54 locked together with locking pins 56 and 58. A tether sleeve 60 is connected to the opposite end of the arm 52 by a locking pin 62 and mounts a tether pin assembly 64. A whiffle ball 66 is tethered from a flexible tether 68 suspended from the tether pin assembly 64.

Figure 5:
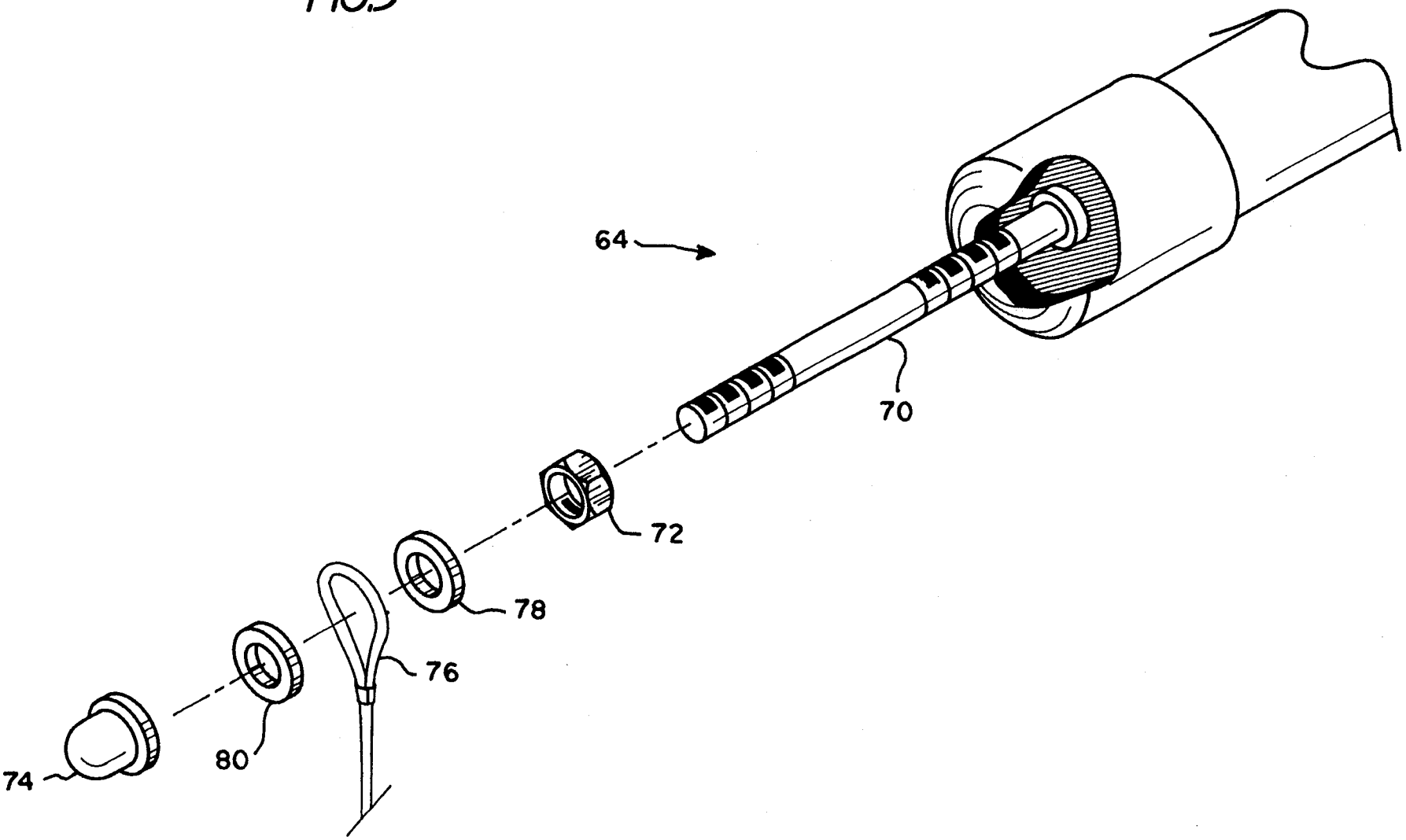
FIG. 5 is an exploded perspective detail view of a tether pin assembly employed in the configuration illustrated in FIG. 3.

The tether pin assembly 64 is shown in detail in FIG. 5. A bolt 70 is embedded into the tether sleeve 60. At its head end the bolt 70 has mating threads, over which a nut 72 is screwed. The other end of the bolt 70 has mating threads over which a cap 74 is screwed. The length of the bolt 70 between the nut 72 and the cad 74 is machined to a smooth finish. This smooth portion accommodates the tether swing 76, which mounts the flexible tether 68. The tether swing 76 has a larger diameter than the bolt 70 so that it can swing freely when the ball is struck. The tether swing 76 is protected from the nut 72 and the cap 74 by a pair of washers 78 and Disassembly of the batting tee into small, manageable parts for storage or transporting it is easily accomplished. The adjustable rubber sleeve 38 is stored as one piece. By removing the locking pin 46, the tether assembly 64 can be removed from the lower post 18. After the tether assembly 40 is removed, the locking pin 46 is reinserted and locked into one of the mating holes 48 of the tether assembly 40 for storage. The arm 52 of the tether assembly 40 can be removed from the upper post 50 by removing either of locking pins 56 or 58. The connecting elbow 54 remains with either the arm 52 or the upper post 50, depending on which pin is removed. The pin 56 or 58 that is removed is inserted and locked into the appropriate hole of the connecting elbow 54 for storage. The tether sleeve 60 can be removed from the arm 52 in a similar manner.

The final step of disassembly is the removal of the lower post 18 and the resilient sleeve 20 from the rubber cover 12 and the standard 16. This step is accomplished by removing the locking bolt 30, washer 34 and nut 36 from the protrusion locking hole 32 and the lower post and resilient sleeve locking holes 28 and 26 and disengaging the lower post 18 and the resilient sleeve 20 from the protrusion 14. The locking bolt 30 is reinserted through the protrusion locking hole 32 and fastened by washer 34 and nu 36, holding the rubber cover 12 and the metal standard 16 together. The components of the batting tee—the rubber cover 12 and metal standard 16, the lower post 18 and resilient sleeve 20, the adjustable rubber sleeve 38, the upper post 50, the arm 52, and the tether sleeve 60—can be conveniently stored or transported.

It is to be understood that the present invention is not limited to the sole embodiment described above, but encompasses any and all embodiments within the scope of the following claims.

I claim:

1. A batting practice tee comprising:

a substantially planar standard having an overlying cover, said cover defining a periphery representative of that of a baseball home plate, a tubular protrusion extending upwardly from said standard, a lower post attached to said tubular protrusion, a resilient sleeve surrounding said lower post, an upper post telescopically engaging said lower post, said upper post having a top end and a bottom end selectively positionable at various elevations relative said lower post, an arm provided with an inner end opposite an outer end, said arm extending laterally of said upper post with said arm inner end affixed to said upper post top end, a flexible tether attached to said arm outer end and having a ball suspended therefrom, said lower post and resilient sleeve provided with mating holes selectively alignable upon vertical displacement of said upper post relative to said lower post, and a lock device engageable with said mating holes to retain said upper post at a fixed elevation relative to said lower post.

2. The batting practice tee of claim 1 wherein said tubular protrusion said lower post and said resilient sleeve are locked together by means of a locking bolt extended through a hole in said lower post, a hole in said resilient sleeve, and a hole in said tubular protrusion.

3. The batting practice tee of claim 2 wherein said standard fabricated of metal and said cover is made of a rubber material.

4. The batting practice tee of claim 1 wherein said lock device comprises a pin.

5. The batting practice tee of claim 1 further comprising an adjustable sleeve that telescopically engages said lower post upon the removal of said upper post and said lock device, said adjustable sleeve having an upper terminal end dimensioned and configured to receive a ball thereupon.

6. The batting practice tee of claim 5 wherein said adjustable sleeve is made of a rubber material and is held at a desired height relative to said lower post by a friction fit.

7. A batting practice tee comprising:

a substantially planar standard having an overlying cover, said cover defining a periphery representative of that of a baseball home plate, a tubular protrusion extending upwardly from said standard, a lower post attached to said tubular protrusion, a resilient sleeve surrounding said lower post, said lower post and said resilient sleeve provided with mating holes, an upper post and an adjustable sleeve, interchangeable with each other and separately usable to form two different types of batting tees;

said upper post:

telescopically engaging said lower post, said upper post having a bottom end selectively positionable at various elevations relative said lower post, further comprising an arm provided with an inner end opposite an outer end, said arm extending laterally of said upper post with said arm inner end affixed to said upper post top end, further comprising a flexible tether attached to said arm outer end and having a ball suspended therefrom, vertically displaced relative to said lower post by selective alignment of said mating holes of said lower post and its associated sleeve, and retained at a fixed elevation relative to said lower post by a lock device engageable with said mating holes;

said adjustable sleeve:

telescopically engages said lower post upon the removal of said upper post and said lock device, having an upper terminal end dimensioned and configured to receive a ball thereupon, is made of a rubber material and is held at a desired height relative to said lower post by a friction fit.

8. The batting practice tee of claim 7 wherein said tubular protrusion said lower post and said resilient sleeve are locked together by means of a locking bolt extended through a hole in said lower post, a hole in said resilient sleeve and a hole in said tubular protrusion.

9. The batting practice tee of claim 8 wherein said standard is fabricated of metal and said cover is made of a rubber material.

10. The batting practice tee of claim 7 wherein said lock device comprises a pin.

11. A method of making a batting practice tee comprising the steps of:

providing a substantially planar standard having an overlying cover, the cover defining a periphery representative of that of a baseball home plate, a tubular protrusion extending upwardly from said standard, attaching a lower post to said tubular protrusion, placing a resilient sleeve around the lower post, placing an upper post in telescopic engagement with the lower post and its associated sleeve, the upper post having a bottom end selectively positionable at various elevations relative to said lower post, providing an arm with an inner end opposite an outer end, the arm extending laterally of the upper post with the arm .inner end affixed to the upper post top end, providing a flexible tether attached to the arm outer end and having a ball suspended therefrom, providing the lower post and its resilient sleeve with mating holes selectively alignable upon vertical displacement of the upper post relative to the lower post, and providing a lock device engageable with the mating holes to retain the upper post at a fixed elevation relative to the lower post.

12. The method of making a batting practice tee as recited in claim 11 wherein the step of attaching the lower post to the tubular protrusion comprises inserting a bolt through a hole in the lower post and a hole in the tubular protrusion.

13. The method of making a batting practice tee as recited in claim 11 wherein the lock device comprises a pin.

14. The method of making a batting practice tee as recited in claim 11 further comprising the step of removing the upper post and the lock device, providing an adjustable sleeve, and inserting the adjustable sleeve into the lower post, the adjustable sleeve having an upper terminal end dimensioned and configured to receive a ball thereupon.

15. The method of making a batting practice tee as recited claim 14 wherein the adjustable sleeve is made of a rubber material and is held at a desired height relative to the lower post by a friction fit.

* * * * *